US010674767B2

(12) United States Patent
Hedarchet

(10) Patent No.: US 10,674,767 B2
(45) Date of Patent: Jun. 9, 2020

(54) CONTROLLING AN AEROSOL-GENERATING SYSTEM

(71) Applicant: Philip Morris Products S.A., Neuchatel (CH)

(72) Inventor: Stephane Antony Hedarchet, Pully (CH)

(73) Assignee: Philip Morris Products S.A., Neuchatel (CH)

( * ) Notice: Subject to any disclaimer, the term of this patent is extended or adjusted under 35 U.S.C. 154(b) by 264 days.

(21) Appl. No.: 15/573,189

(22) PCT Filed: May 23, 2016

(86) PCT No.: PCT/EP2016/061610
§ 371 (c)(1),
(2) Date: Nov. 10, 2017

(87) PCT Pub. No.: WO2016/188967
PCT Pub. Date: Dec. 1, 2016

(65) Prior Publication Data

US 2018/0098576 A1 Apr. 12, 2018

(30) Foreign Application Priority Data

May 26, 2015 (EP) ..... 15169250

(51) Int. Cl.
*H05B 1/02* (2006.01)
*A24F 47/00* (2020.01)

(52) U.S. Cl.
CPC ..... *A24F 47/008* (2013.01); *H05B 1/02* (2013.01)

(58) Field of Classification Search
CPC ..... A24F 47/008; A24F 15/06; H01M 11/042; H05B 1/02; H05B 3/20
(Continued)

(56) References Cited

U.S. PATENT DOCUMENTS 9,668,521 B2 * 6/2017 Kuczaj ..... H05B 1/0225
9,854,841 B2 * 1/2018 Ampolini ..... A24F 47/008
(Continued)

FOREIGN PATENT DOCUMENTS

CN 102940313 A 2/2013
CN 102940314 A 2/2013
(Continued)

OTHER PUBLICATIONS

International Preliminary Report on Patentability and Written Opinion dated Dec. 7, 2017 in PCT /EP2016/061610.
(Continued)

*Primary Examiner* — Mark H Paschall
(74) *Attorney, Agent, or Firm* — Oblon, McClelland, Maier & Neustadt, L.L.P.

(57) ABSTRACT

There is provided method of controlling an electrically operated aerosol-generating system, including: receiving an input being a first request to adjust a first parameter of the system; comparing the input to a first range of allowable values for the first parameter; providing an authorizing signal indicating that the input is within the range of allowable values for the first parameter; determining an adjustment to a second range of allowable values for a second parameter, which is dependent on the first parameter, and in dependence on the input; and adjusting the first parameter and the second range of allowable values for the second parameter, in dependence on the authorizing signal. There is also provided an electrically operated aerosol-generating device and an electrically operated aerosol-generating system.

12 Claims, 4 Drawing Sheets

Figure 1:
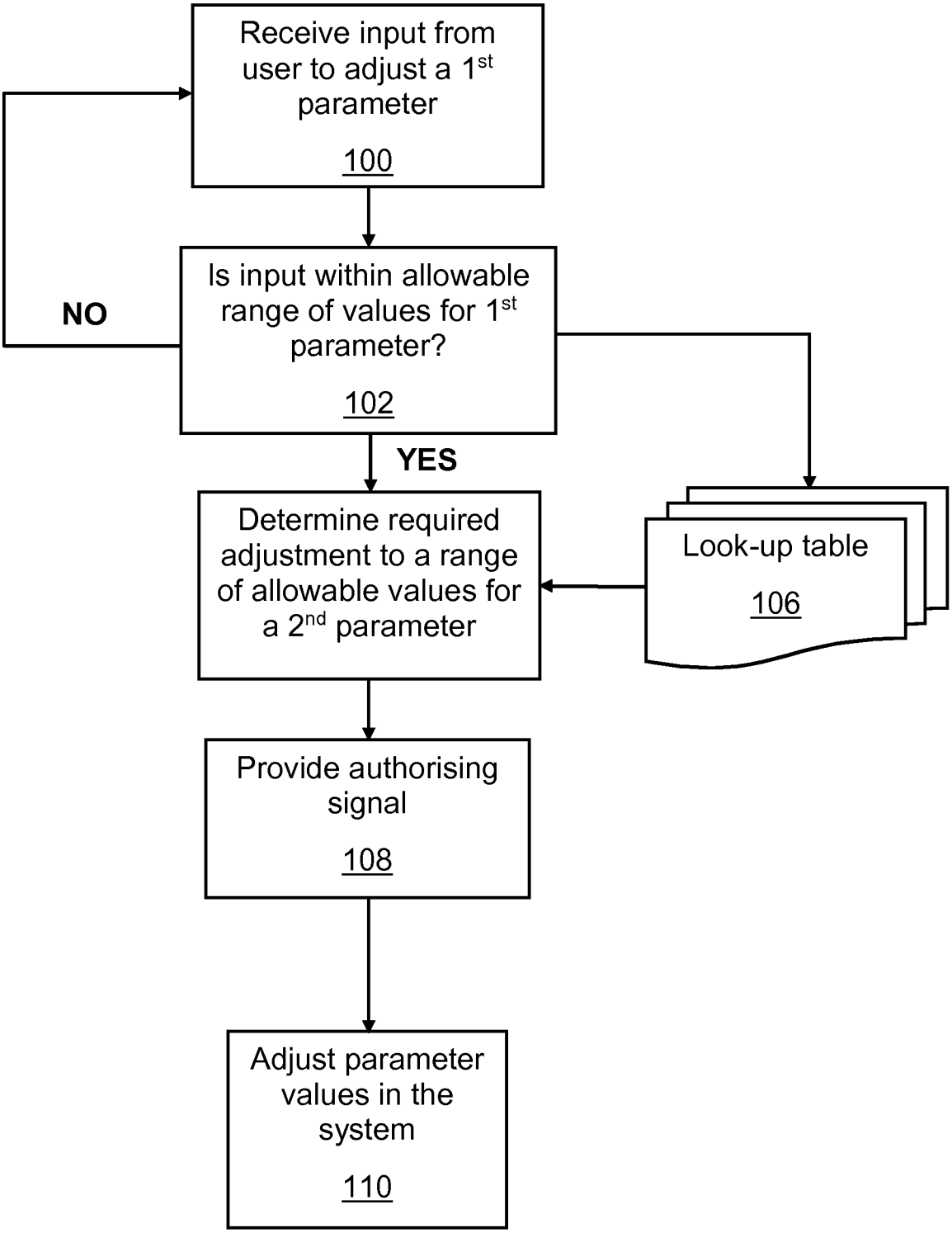

(58) Field of Classification Search
USPC ..... 219/490, 483, 486, 506, 497; 392/395; 131/328, 329
See application file for complete search history.

(56) References Cited

U.S. PATENT DOCUMENTS

| | | | | |
|---|---|---|---|---|
| 2007/0212103 | A1* | 9/2007 | Kikuchi | G03G 15/0283 399/88 |
| 2011/0265806 | A1* | 11/2011 | Alarcon | A24F 47/008 131/273 |
| 2013/0340775 | A1 | 12/2013 | Juster et al. | |
| 2014/0123990 | A1 | 5/2014 | Timmermans | |
| 2014/0334804 | A1 | 11/2014 | Choi | |
| 2014/0345633 | A1* | 11/2014 | Talon | A61M 11/042 131/329 |
| 2015/0053217 | A1* | 2/2015 | Steingraber | A24F 47/008 131/329 |
| 2015/0237916 | A1 | 8/2015 | Farine et al. | |

FOREIGN PATENT DOCUMENTS

| | | | |
|---|---|---|---|
| CN | 103653261 | A | 3/2014 |
| CN | 203597405 | U | 5/2014 |
| CN | 103838202 | A | 6/2014 |
| CN | 103889258 | A | 6/2014 |
| CN | 103945716 | A | 7/2014 |
| EP | 0 295 122 | B1 | 1/1992 |
| EP | 1 618 803 | B1 | 12/2008 |
| EP | 1 736 065 | B1 | 6/2009 |
| WO | WO 2014/040988 | A2 | 3/2014 |
| WO | WO 2014/195805 | A2 | 12/2014 |

OTHER PUBLICATIONS

International Search Report and Written Opinion dated Aug. 17, 2016 in PCT/EP2016/061610, filed May 23, 2016.

Combined Chinese Office Action and Search Report dated Nov. 27, 2019, in Patent Application No. 201680027862.0, 13 pages (with English translation).

* cited by examiner

CONTROLLING AN AEROSOL-GENERATING SYSTEM

The present invention relates to a method of controlling an electrically operated aerosol-generating system.

A number of prior art documents, for example EP-A-0 295 122, EP-A-1 618 803 and EP-A-1 736 065, disclose electrically operated smoking systems, having a number of advantages. One advantage of some examples of such systems is that they can significantly reduce sidestream smoke, while permitting the smoker to selectively suspend and reinitiate smoking.

Prior art documents, such as EP-A-0 295 122, EP-A-1 618 803 and EP-A-1 736 065, disclose electrical smoking systems which use a liquid as the aerosol-forming substrate. The liquid may be contained in a cartridge which is receivable in a housing. A power supply, such as a battery, is provided, connected to a heater to heat the liquid substrate during a puff, to form the aerosol which is provided to the smoker.

US 2014/0334804 A1 describes a system in which it is sought to provide the user with some control over selected settings of the electrical smoking system. In the system disclosed in this document the user can control one or both of the heating time and the heating stop time.

There would be benefit in an improved or alternative means of controlling an aerosol-generating system.

According to one aspect of the present invention, there is provided a method of controlling an electrically operated aerosol-generating system. The method comprises: receiving an input from a user, the input being a request to adjust a first parameter of the system; comparing the input to a range of allowable values for the first parameter; providing an authorising signal indicating that the input is within the range of allowable values for the first parameter; determining an adjustment to a range of allowable values for a second parameter, dependent on the first parameter, in dependence on the input; and adjusting the first parameter and the range of allowable values for the second parameter, in dependence on the authorising signal.

Advantageously, providing such a method enables the user to control aspects of the system's operation and to indicate to the user the consequences of the changes made. By determining an adjustment to a range of allowable values for a second parameter based on the adjustment to the first parameter requested by the user, the user can be provided with information related to the consequences of the requested change, and thereby increase the freedom to adjust parameters of an aerosol-generating system without undesirable consequences.

The method may further comprise comparing the present second parameter value to the adjusted range of allowable values for the second parameter; and, adjusting the second parameter value if the present second parameter value is outside of the adjusted range of allowable values. The second parameter value may be adjusted to be the value of the lower end of the allowable range, or to be the value of the higher end of the allowable range in dependence on whether the present value is lower than the value of the lower end, or higher than the value of the higher end respectively.

The method may further comprise adjusting a range of allowable values for a third parameter dependent on the first parameter, in dependence on the user input requesting an adjustment to the first parameter. As will now be appreciated, the user input may result in adjustments to one, two, three, or more ranges of allowable values for parameters.

Preferably, in a first embodiment, the method further comprises: receiving a second input from a user, the second input being a request to adjust the second parameter of the system; comparing the second input to the adjusted range of allowable values for the second parameter; providing the authorising signal, further indicating that the second input is within the adjusted range of allowable values for the second parameter; and adjusting the second parameter, in dependence on the authorising signal.

Enabling the user to also adjust the second parameter provides yet more flexibility to the user to adjust the system to their preferences, while remaining within allowable ranges. Providing the user with a range of allowable values for the second parameter which has been adjusted based on the user's requirement for the first parameter is advantageous. The method avoids the situation where the user requests a set of values for parameters which are technically mutually exclusive. For example, requesting a significant increase in power to a heating element of the system will likely be mutually exclusive to requesting an increase in the battery life-time. Avoiding such a situation provides the user with an improved user experience.

The method of this first embodiment may further comprise: determining a required adjustment to at least one further parameter, dependent on at least one of the first parameter and the second parameter, in dependence on at least one of the first input and the second input; and adjusting the at least one further parameter, in dependence on the authorising signal. The further parameter may not be directly adjustable by the user, and in this case thus is only adjusted in dependence on the user adjusting other parameters. The user input in relation to one parameter may require adjustments to a plurality of further parameters. One, some, or all of the further parameters may not be directly adjustable by the user.

Similarly, advantageously, by determining required adjustments for a yet further parameter, based on the adjustments requested by the user, the user can be provided with yet further increased freedom to adjust parameters of an aerosol-generating system. The system determined adjustments to the further parameter reduces the risk of the user input leading to an undesirable or damaging combination of parameter values.

In the first embodiment, the range of allowable values for each parameter may be adjusted in dependence on the value of each other parameter.

Thus, the method of the invention may enable the user to adjust one, two, three, four, five, six or more parameters of an aerosol-generating system. The parameters may all be interdependent, or each parameter may only be interdependent on a subset of the remaining parameters, or a combination may be provided such that at least one of the parameters is dependent on the remaining parameters, and at least one parameter is dependent on only a subset of the remaining parameters.

The method may adjust the range of allowable parameter values even where a combination of parameter values is technically achievable by the system. In this way, undesirable consequences of the combination of parameter values can be avoided. For example, a combination of parameter values that would result in an aerosol temperature above a recommended value may be restricted.

The step of determining the adjustment to the range of allowable values for the second parameter may comprise using a look-up table correlating the user input value for the first parameter to the range of allowable second parameter values. In a similar manner, a look-up table may be provided comprising each combination of allowable ranges of parameter values given a required parameter value or set of values from the user.

An algorithm may be used to determine the adjustment to the range of allowable values for the second parameter. Again, similarly, an algorithm may be provided to determine the required adjustment to a further parameter given the user's required adjustment to a first parameter and a second parameter. Some or all of the adjustable parameters may relate directly to the control input, e.g. a voltage applied to the electrical heater, in the device. That is to say, there may be a linear relationship between the adjustable parameter, e.g. 1 to 5, and the control input in the device.

Some or all of the adjustable parameters may have a non-linear relationship between the adjustable parameter value selectable by the user, e.g. from zero to high. That is to say, the control input, e.g. the control input to the flavour release means, in the device may increase in a non-linear manner.

The method may further comprise requesting a confirmation input from the user before adjusting the or each parameter. In this way, the user can decide whether to re-adjust the first parameter if the adjustment to the range of allowable values for the second parameter is not satisfactory. For example, the user could increase the heat requirement to increase the generation of the aerosol, but not be satisfied with the corresponding reduction in battery life-time.

The at least one parameter may relate to an aerosol characteristic. The aerosol characteristic may be at least one of: nicotine concentration; aerosol-forming substrate composition; aerosol density; aerosol temperature; taste; and flavour level.

The nicotine concentrations may be "low", "medium" and "high". The aerosol density may be "low", "medium" and "high". The flavour levels may be "no flavour", "low mint", and "high mint". As will be appreciated, the parameter values may be numerical equivalents to these named values. The aerosol-forming substrate composition may be mixed within the device, and thus an adjustable parameter may be the relative weights of each constituent of the composition. This may be achieved by adjusting the power supplied to each of a plurality of heaters, each heater configured to vapourise a constituent of the aerosol composition.

The at least one parameter may relate to an aerosol-generating device of the system. The device parameter may be at least one of: heater duration; power level; battery life-time; wireless communication; and resistance-to-draw. For example, the resistance-to-draw may be adjusted by the user to adjust the concentration of aerosol droplets within the airflow. This may enable the concentration, that is density of droplets within the airflow, to be adjusted at least somewhat independently of the heat applied to the aerosol-forming substrate.

The method may further comprise receiving an input from the user requesting the device enter a battery-life extension mode. This may be known as eco-mode. In dependence on the request to enter eco-mode, the device adjusts the range of allowable parameter values for each parameter such that the battery-life is maximised.

According to a further aspect of the present invention, there is provided an electrically operated aerosol-generating device. The device comprises: a power supply; control circuitry; an input for receiving at least one user input; and an electrical heater configured to receive power from the power supply via the control circuitry to heat an aerosol-forming substrate. The control circuitry is configured to carry out the control method as described herein.

The input is preferably configured to receive the or each at least one user input from a remote device. The aerosol-generating device preferably further comprises means for providing a communications link with the remote device. The communications link may be a wired communication link, or a wireless communication link. An example of the communications link is described in further detail below.

The aerosol-generating device may be provided with means for receiving the at least one user input directly. The receiving means may be a plurality of buttons, plurality of sliders, a touch sensor, or voice recognition system, or a combination of two or more of these. For example, the receiving means may be configured to receive the user input to request eco-mode.

The device preferably comprises a mouthpiece. As used herein, the term "mouthpiece" preferably refers to a portion of an aerosol-generating system, an aerosol-generating article, or the aerosol-generating device, that is placed into a user's mouth in order to directly inhale an aerosol generated by the aerosol-generating system.

The device preferably comprises a housing, being the outer body, and may comprise the part that is held by the user.

The system may comprise more than one heating element, for example two, or three, or four, or five, or six or more heating elements. The heating element or heating elements may be arranged appropriately so as to most effectively heat the aerosol-forming substrate.

The at least one electric heating element preferably comprises an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, Constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation, 1999 Broadway Suite 4300, Denver Colo. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise Kapton®, all-polyimide or mica foil. Kapton® is a registered trade mark of E.I. du Pont de Nemours and Company, 1007 Market Street, Wilmington, Del. 19898, United States of America.

The at least one electric heating element may comprise an infra-red heating element, a photonic source, or an inductive heating element.

The at least one electric heating element may take any suitable form. For example, the at least one electric heating element may take the form of a heating blade. The at least one electric heating element may take the form of a casing or substrate having different electro-conductive portions, or an electrically resistive metallic tube. If the aerosol-forming substrate is a liquid provided within a container, the container may incorporate a disposable heating element. One or more heating needles or rods that run through the centre of the aerosol-forming substrate may be used. The at least one electric heating element may be a disk (end) heating element or a combination of a disk heating element with heating needles or rods. The at least one electric heating element may comprise a flexible sheet of material arranged to surround or partially surround the aerosol-forming substrate. Other possibilities include a heating wire or filament, for example a Ni—Cr, platinum, tungsten or alloy wire, or a heating plate. Optionally, the heating element may be deposited in or on a rigid carrier material.

The at least one electric heating element may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. Preferably, the material has a high heat capacity (sensible heat storage material), or is a material capable of absorbing and subsequently releasing heat via a reversible process, such as a high temperature phase change. Suitable heat storage materials include silica gel, alumina, carbon, glass mat, glass fibre, minerals, a metal or alloy such as aluminium, silver or lead, and a cellulose material such as paper. Other materials which release heat via a reversible phase change include paraffin, sodium acetate, naphthalene, wax, polyethylene oxide, a metal, metal salt, a mixture of eutectic salts or an alloy.

The heat sink or heat reservoir may be arranged such that it is directly in contact with the aerosol-forming substrate and can transfer the stored heat directly to the substrate. The heat stored in the heat sink or heat reservoir may be transferred to the aerosol-forming substrate by means of a heat conductor, such as a metallic tube.

The at least one heating element may heat the aerosol-forming substrate by conduction. The heating element may be at least partially in contact with the substrate, or the carrier on which the substrate is deposited. The heat from the heating element may be conducted to the substrate by a heat conductive element.

The at least one heating element may transfer heat to the incoming ambient air that is drawn through the electrically heated aerosol generating system during use, which in turn heats the aerosol-forming substrate by convection. The ambient air may be heated before passing through the aerosol-forming substrate. If the aerosol-forming substrate is a liquid substrate, the ambient air may be first drawn through the substrate and then heated.

The aerosol-forming substrate may be a solid aerosol-forming substrate. The aerosol-forming substrate preferably comprises a tobacco-containing material containing volatile tobacco flavour compounds which are released from the substrate upon heating. The aerosol-forming substrate may comprise a non-tobacco material. The aerosol-forming substrate may comprise tobacco-containing material and non-tobacco containing material. Preferably, the aerosol-forming substrate further comprises an aerosol former. Examples of suitable aerosol formers are glycerine and propylene glycol.

The aerosol-forming substrate may be a liquid aerosol-forming substrate. The electrically heated aerosol generating system may further comprise a liquid storage portion. Preferably, the liquid aerosol-forming substrate is stored in the liquid storage portion. The electrically heated aerosol generating device may further comprise a capillary wick in communication with the liquid storage portion. It is also possible for a capillary wick for holding liquid to be provided without a liquid storage portion. In that case, the capillary wick may be preloaded with liquid.

Preferably, the capillary wick is arranged to be in contact with liquid in the liquid storage portion. In that case, in use, liquid is transferred from the liquid storage portion towards the at least one electric heating element by capillary action in the capillary wick. In one embodiment, the capillary wick extends into the liquid storage portion. When the heating element is activated, liquid in the capillary wick is vaporized by the heating element to form the supersaturated vapour. The supersaturated vapour is mixed with and carried in the airflow. During the flow, the vapour condenses to form the aerosol and the aerosol is carried towards the mouth of a user. The heating element in combination with a capillary wick may provide a fast response, because that arrangement may provide a high surface area of liquid to the heating element. Control of the heating element according to the invention may therefore depend on the structure of the capillary wick or other heating arrangement.

The liquid substrate may be absorbed into a porous carrier material, which may be made from any suitable absorbent plug or body, for example, a foamed metal or plastics material, polypropylene, terylene, nylon fibres or ceramic. The liquid substrate may be retained in the porous carrier material prior to use of the electrically heated aerosol generating device. or, The liquid substrate material may be released into the porous carrier material during, or immediately prior to use.

If the aerosol-forming substrate is a liquid substrate, control of the at least one electric heating element may depend upon the physical properties of the liquid substrate, such as the boiling point, vapour pressure, and surface tension. The liquid preferably comprises a nicotine-containing material, such as a tobacco-containing material comprising volatile tobacco flavour compounds which are released from the liquid upon heating. Alternatively, or in addition, the liquid may comprise a non-tobacco material. The liquid may include water, solvents, ethanol, plant extracts and natural or artificial flavours. Preferably, the liquid further comprises an aerosol former. Examples of suitable aerosol formers are glycerine and propylene glycol.

An advantage of providing a liquid storage portion is that a high level of hygiene can be maintained. Using a capillary wick extending between the liquid and the electric heating element, allows the structure of the device to be relatively simple. The liquid has physical properties, including viscosity and surface tension, which allow the liquid to be transported through the capillary wick by capillary action. The liquid storage portion is preferably a container. The liquid storage portion may not be refillable. Thus, when the liquid in the liquid storage portion has been used up, the aerosol generating device is replaced. The liquid storage portion may be refillable. In that case, the aerosol generating device may be replaced after a certain number of refills of the liquid storage portion. Preferably, the liquid storage portion is arranged to hold liquid for a pre-determined number of puffs.

The capillary wick may have a fibrous or spongy structure. The capillary wick preferably comprises a bundle of capillaries. For example, the capillary wick may comprise a plurality of fibres or threads, or other fine bore tubes. The fibres or threads may be generally aligned in the longitudinal direction of the aerosol generating device. The capillary wick may comprise sponge-like or foam-like material formed into a rod shape. The rod shape may extend along the longitudinal direction of the aerosol generating device. The structure of the wick forms a plurality of small bores or tubes, through which the liquid can be transported to the electric heating element, by capillary action. The capillary wick may comprise any suitable material or combination of materials. Examples of suitable materials are ceramic- or graphite-based materials in the form of fibres or sintered powders. The capillary wick may have any suitable capillarity and porosity so as to be used with different liquid physical properties such as density, viscosity, surface tension and vapour pressure. The capillary properties of the wick, combined with the properties of the liquid, ensure that the wick is always wet in the heating area.

The aerosol-forming substrate may be any other sort of substrate, for example, a gas substrate, or any combination of the various types of substrate. During operation, the substrate may be completely contained within the electrically heated aerosol generating device. In that case, a user may puff on a mouthpiece of the electrically heated aerosol generating device. During operation, the substrate may be partially contained within the electrically heated aerosol generating device. In that case, the substrate may form part of a separate article and the user may puff directly on the separate article.

The electrically heated aerosol generating system may comprise an aerosol-forming chamber in which aerosol forms from a super saturated vapour, which aerosol is then carried into the mouth of a user. An air inlet, air outlet and the chamber are preferably arranged so as to define an airflow route from the air inlet to the air outlet via the aerosol-forming chamber, so as to convey the aerosol to the air outlet and into the mouth of a user.

Preferably, the aerosol generating device is portable. The aerosol generating device may be a smoking device and may have a size comparable to a conventional cigar or cigarette. The smoking device may have a total length between approximately 30 mm and approximately 150 mm. The smoking device may have an external diameter between approximately 5 mm and approximately 30 mm.

According to a yet further aspect of the present invention, there is provided a storage medium for an electrically operated aerosol-generating system. The storage medium comprises: a set containing a plurality of parameter values, each parameter value corresponding to a parameter of the system, the parameters being dependent on each other, wherein: a first of the plurality of parameter values corresponds to a maximum allowable value for the corresponding parameter of the system; and the other of the plurality of parameter values correspond to required values to enable the first parameter to be a maximum allowable value.

Advantageously, the storage medium enables the user to select a preset set of parameter values to maximise a parameter of the system. In this way, the user can more easily and efficiently maximise a desired characteristic of the system. For example, the user could maximise battery life-time, aerosol density, or flavour.

The storage medium preferably further comprises a plurality of sets, each set containing a plurality of parameter values. Each set containing a plurality of parameter values comprises a different parameter value corresponding to a maximum allowable value.

One such set containing a plurality of parameter values may enable eco-mode.

According to a still further aspect of the present invention, there is provided an electronic display device for an electrically-operated aerosol-generating system configured to carry out a control method described herein. The display device is configured to: display a plurality of adjustable parameter values, each parameter value corresponding to a parameter of the electrically-operated aerosol-generating system; display a range of allowable values for each of the plurality of parameter values; and display an adjusted range of allowable values for at least one of the plurality of parameter values in dependence on a user input, the user input being a request to adjust another one of the parameter values.

Providing such a display device enables the user interface with the control system to be more efficient and more effective. The user may quickly and easily be able to determine the potential settings that can be made to ensure their specific requirements for the aerosol-generating device are met. The user may prioritise their favoured functions, and desired outcomes of the device, and be provided with a visual indicator as to the effects of that prioritisation.

The electronic display device is preferably configured to plot the parameter values on a radar diagram. Using a radar diagram further emphasises to the user the impact of adjusting parameter values.

The electronic display device is preferably a touchscreen device further configured to receive a user input. Where the display device uses a radar diagram, preferably the touchscreen is configured to enable the user to adjust the parameter values directly on the radar diagram. The user may slide an icon representing the parameter along a radial axis of the radar diagram. The electronic display device may further display a confirmation button to enable the user to confirm that the required adjustments to parameters other than the manually adjusted parameters is acceptable.

The electronic display device is preferably further configured to communicate over a communications link with an electrically-operated aerosol-generating device. The communications link is preferably suitable for flow of data from the electronic display device to the electrically operated aerosol-generating device. The communications link may be suitable for flow of data from the electrically operated aerosol-generating device to the electronic display device. Preferably, the communications link is suitable for bi-directional flow of data, from the electrically operated aerosol-generating device to the electronic display device and from the electronic display device to the electrically operated aerosol-generating device.

The communications link may be a wired communication link, or a wireless communication link. Preferably, the communications link operates under an interface standard. An interface standard is a standard that describes one or more functional characteristics, such as code conversion, line assignments, or protocol compliance, or physical characteristics, such as electrical, mechanical, or optical characteristics, necessary to allow the exchange of information between two or more systems or pieces of equipment. Examples of suitable interface standards for the communications link include, but are not limited to, the Recommended Standard 232 (RS-232) family of standards; Universal Serial Bus (USB); Bluetooth; FireWire (a brand name of Apple, Inc for their IEEE 1394 interface), IrDA (Infrared Data Association—a communications standard for the short-range exchange of data by Infrared light); Zigbee (a specification based on the IEEE 802.15.4 standard for wireless personal area networks) and other Wi-Fi standards.

In a preferred embodiment, the communications link is wireless. The interface is an interface suitable for the particular wireless communications link. For example, the interface may comprise one of: a receiver for receipt of wireless signals from the electrically operated aerosol-generating device; a transmitter for sending wireless signals to the electrically operated aerosol-generating device; and a transceiver for receiving wireless signals from, and sending wireless signals to, the electrically operated aerosol-generating device. For example, in the case of a wired communications link, the interface may comprise one or both of: a male connector for connection with a female connector on or connected to the electrically operated aerosol-generating device; and a female connector for connection with a male connector on or connected to the electrically operated aerosol-generating device.

According to a still further aspect of the present invention, there is provided an electrically operated aerosol-generating system. The system comprises: an electrically operated aerosol-generating device as described herein; and an electronic display device as described herein, comprising a storage medium as described herein. A communications link, as described above, is provided between the electrically operated aerosol-generating device and the electronic display device.

According to a yet further aspect of the present invention, there is provided a computer readable medium comprising instructions for carrying out a method of controlling an electrically operated aerosol-generating system as described herein.

According to a yet still further aspect of the present invention, there is provided a computer program for carrying out a method of controlling an electrically operated aerosol-generating system as described herein.

Any feature in one aspect of the invention may be applied to other aspects of the invention, in any appropriate combination. In particular, method aspects may be applied to apparatus aspects, and vice versa. Furthermore, any, some or all features in one aspect can be applied to any, some or all features in any other aspect, in any appropriate combination.

It should also be appreciated that particular combinations of the various features described and defined in any aspects of the invention can be implemented or supplied or used independently.

The disclosure extends to methods and apparatus substantially as herein described with reference to the accompanying drawings.

Figure 2C:
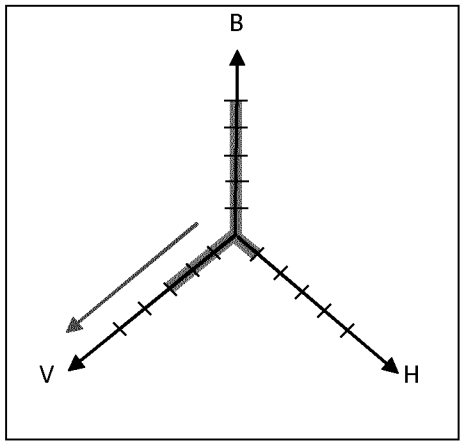
Figure 2B:
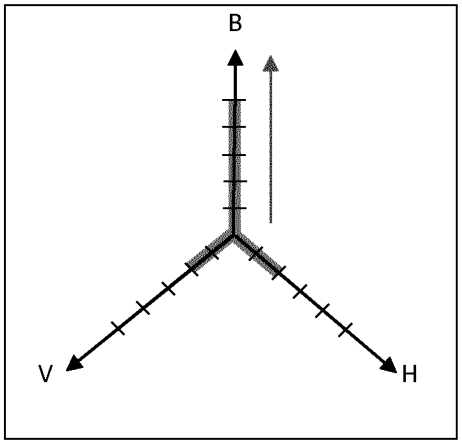
Figure 2A:
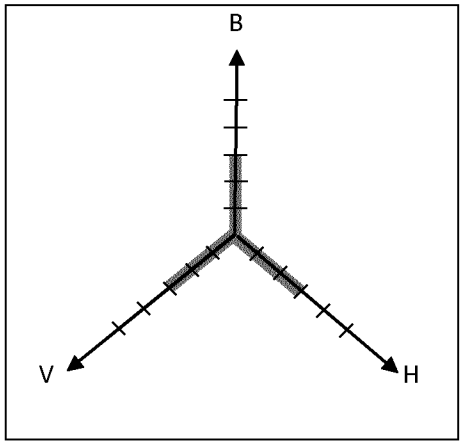
Figure 3:
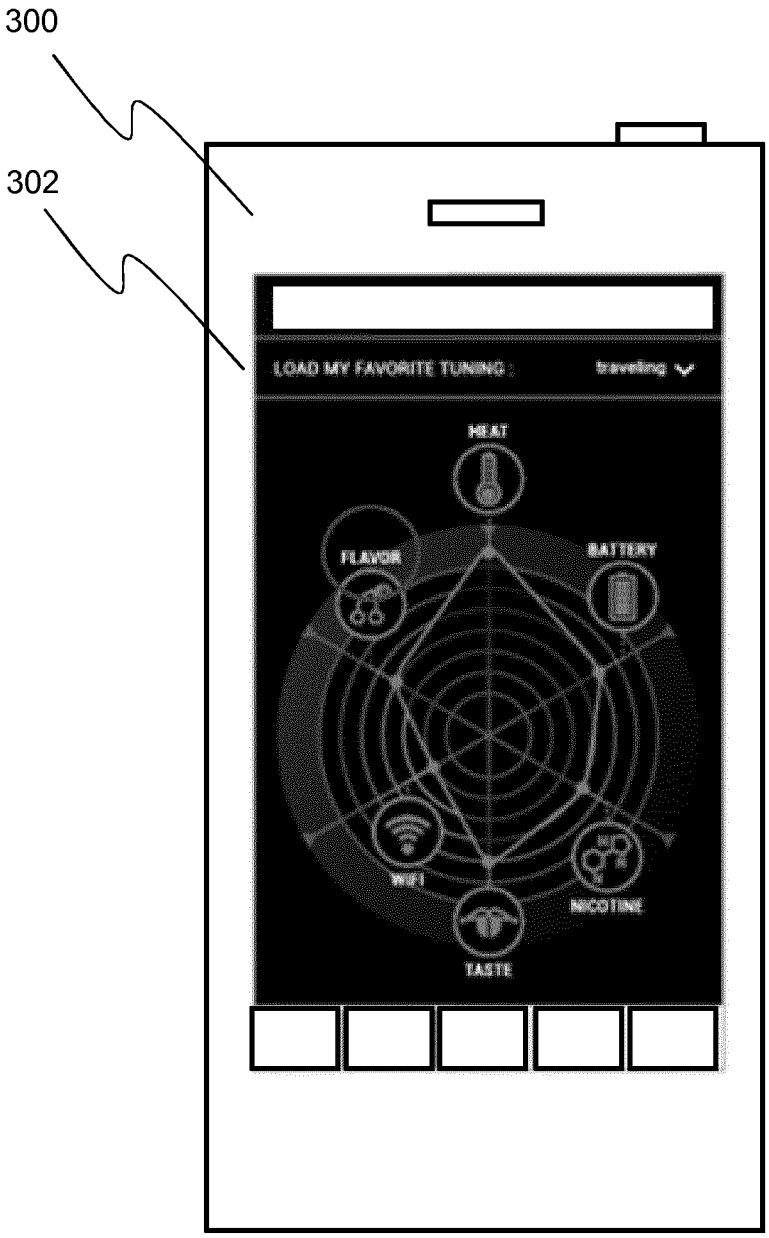
Figure 4:
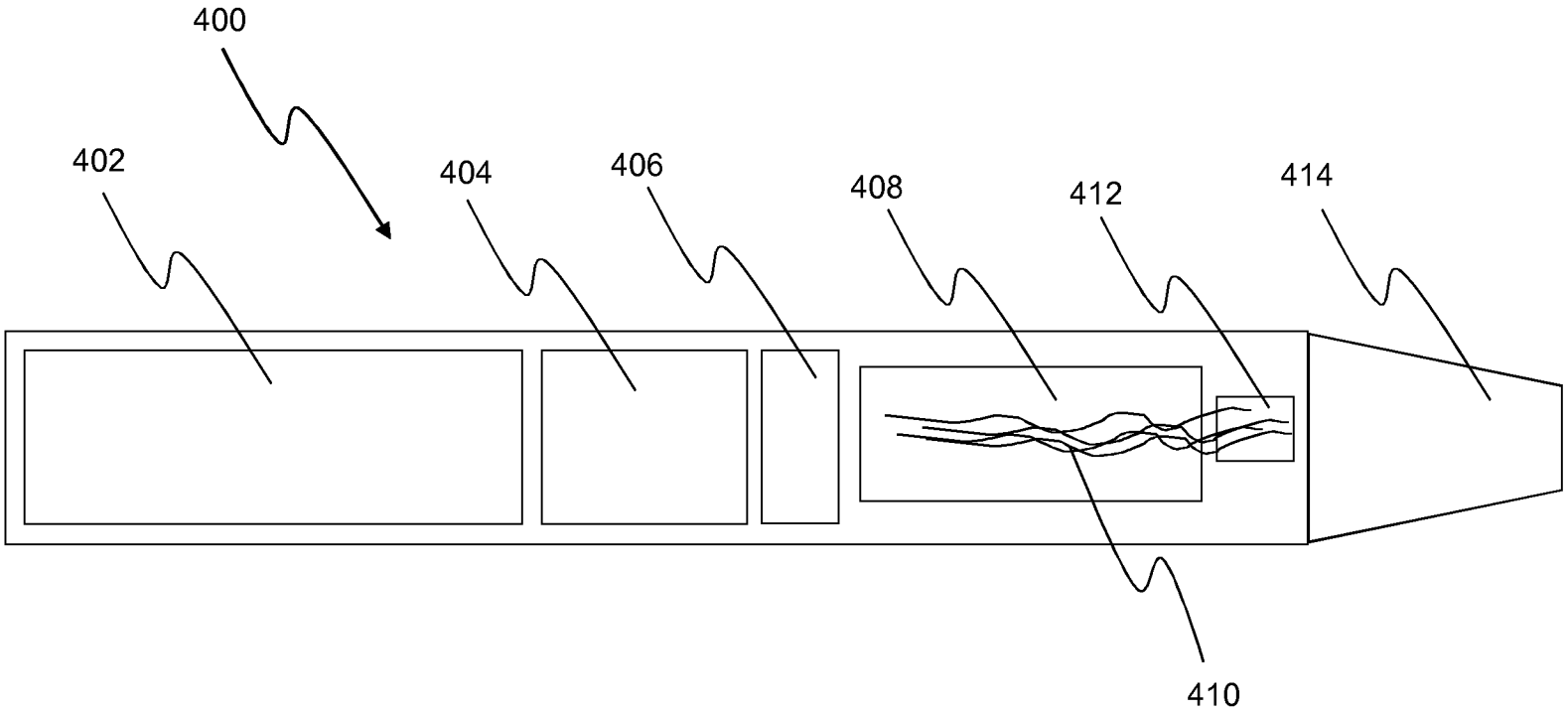

The invention will be further described, by way of example only, with reference to the accompanying drawings in which:

FIG. 1 shows a flow diagram of a method of controlling an electrically operated aerosol-generating system according to one embodiment of the present invention;

FIGS. 2(*a*), 2(*b*) and 2(*c*) show an example of the use of the GUI shown in FIG. 3 below;

FIG. 3 shows a graphical user interface on an electronic control device according to one embodiment of the present invention; and FIG. 4 shows an electrically operated aerosol-generating system according to one embodiment of the present invention.

FIG. 1 shows a flow diagram of a method of controlling an electrically operated aerosol-generating system. The aerosol-generating system comprises a power supply such as a rechargeable battery, control circuitry, a wireless communications device, a liquid storage container comprising a nicotine source and a capillary wick, and an electric heater element. The system may further comprise a second liquid storage container comprising a flavour. The parameter values of the system can be adjusted by the user to produce an aerosol having different properties, or to adjust the operation of the system. The aerosol-generating system is described in further detail below with reference to FIG. 2.

The flow diagram of FIG. 1 shows the control method used to enable a user to adjust a parameter value of the device. At step 100, the system receives an input from a user requesting an adjustment to a first parameter value of the system. In this example, the first parameter may be any one of: the temperature of the aerosol; the battery life-time; the nicotine concentration in the aerosol; the taste of the aerosol; wireless communications; and flavour of the aerosol.

On receipt of the input, at step 102 the method compares the requested parameter value for the first parameter with an allowable range of values for the first parameter. If the requested parameter value is within the allowable range, the method proceeds to step 104. If the requested parameter is not within the allowable range, the method reverts to step 100 and requests a new user input for the parameter value.

At step 104, the method determines an adjustment to a range of allowable values for a second parameter value as a consequence of the user requested adjustment to the first parameter. At least some of the adjustable parameters are interdependent, meaning that adjusting one parameter will affect another parameter. For example, adjusting the temperature of the aerosol will result in a change to the battery life-time. To determine the adjustment, the requested parameter value for the first parameter is used as an input to the look-up table 106.

The method then proceeds to step 108 where an authorising signal is provided to the system to indicate that the adjustments to the parameter values are acceptable. The method then adjusts the parameter values in step 110.

The control method may extend to allowing more than one, and up to all, of the parameter values to be adjusted by the user. In this case, at step 104, instead of the range of allowable values being adjusted, the parameter value itself is automatically adjusted. For example, this may occur if the present value for that parameter is outside of the adjusted allowable range, or if the parameter requiring adjustment is not adjustable by the user. Before providing the authorising signal, all of the requested parameter values must be within the respective allowable ranges.

As a specific example, a system having three adjustable parameters is considered and shown in FIGS. 2(*a*), 2(*b*) and 2(*c*). In this example, the battery life-time, temperature of the aerosol, and aerosol density are the adjustable parameters. For all of the parameters, the initial allowable range is between 1 and 5. The numerical values are arbitrary and are used to represent the relative importance of that parameter. For example, a value of 5 for the battery life-time would be a request for the system to maximum the life-time of the battery between charges.

The three parameters are interdependent, and so increasing the value for battery life-time will decrease the maximum allowable value for both the temperature of the aerosol and aerosol density. As a default, each parameter value for each of parameters is 3. If the user adjusts the battery life-time to 5, as a consequence the temperature of the aerosol parameter value and the aerosol density parameter value will decrease to 2.

If the user then adjusts the aerosol density parameter value to 4, the aerosol temperature parameter value will decrease to 1, the battery life-time parameter value remaining unchanged as this is a user set value.

In order to prevent damage to the system, or undesirable aerosol properties, some combinations of parameter values may be restricted, even if they are technically achievable. For example, it is technically achievable to have a low aerosol density and a high aerosol temperature, but this may result in damaging the system.

The user input may be received from an electronic display and input device, such as a personal computer, mobile telephone such as a smart phone, or dedicated remote control device. One such smart phone display and input device 300 is shown in FIG. 3. As can be seen, the smart phone is configured to display a graphical user interface (GUI) in the form of a radar diagram showing the adjustable parameters of the aerosol-generating system. In this example, the GUI enables the user to view the current parameter value for each parameter. The touchscreen on the smart phone can be used to enable the user to slide the parameters to input a required adjustment. In response, the display will show the required changes to the allowable ranges of parameter values for the remaining parameters, in accordance with the method described above.

In addition to manually changing each parameter value, the smart phone may have preset sets of parameter values stored in memory. The user may then choose the presets using a drop-down menu 302. For example, the user may wish to maximise battery life-time, because they are travelling. Selecting the preset values automatically adjusts all of the other parameter values.

The smart phone 300 is in wireless communication via a communications link with the aerosol-generating system. Before the adjusted settings are provided to the system, the user may be requested to confirm, via a button on the touchscreen, that the new parameter values are acceptable.

An example of an aerosol-generating device 400 of the aerosol-generating system is shown in FIG. 4. As described briefly above, the device 400 comprises a power supply such as a rechargeable battery 402, control circuitry 404, a wireless communications device 406, a liquid storage container 408 comprising a nicotine source and a capillary wick 410, and an electric heater element 412. The system may further comprise a second liquid storage container comprising a flavour (not shown). The device also comprises a mouthpiece 414 which the user draws on to inhale the aerosol. As will be appreciated, the control circuitry of the system is configured to carry out the method as described above with reference to FIG. 1.

In use, the user inputs the desired parameter values into the smart phone 300, and accepts the adjusted parameter values. The smart phone 300 then sends an authorising signal to the device 400 including the adjusted parameter values. The device 400 receives the signal via the communications link between the smart phone 300 and the wireless communications device 406. The new parameter values are then entered into the control memory of the control circuitry 404.

When the user puffs on the device, a puff sensor (not shown) activates the device, and the control circuitry provides power to the heating element in dependence on the stored parameter values. The heating element vapourises the liquid aerosol-forming substrate and the user may inhale the aerosol via the mouthpiece.

The invention has been exemplified above by reference to an electrically operated aerosol-generating device configured to heat a liquid aerosol-forming substrate. However, it will be appreciated that embodiments according to the invention may comprise other forms of aerosol-forming substrate.

The invention claimed is:

1. A method of controlling an electrically operated aerosol-generating system, the method comprising:

receiving an input from a user, the input being a first request to adjust a first parameter of the electrically operated aerosol-generating system;

comparing the input to a first range of allowable values for the first parameter;

providing an authorizing signal indicating that the input is within the range of allowable values for the first parameter;

determining an adjustment to a second range of allowable values for a second parameter, which is dependent on the first parameter, and in dependence on the input; and adjusting the first parameter and the second range of allowable values for the second parameter, in dependence on the authorizing signal.

2. The method according to claim 1, further comprising:

receiving a second input from the user, the second input being a second request to adjust the second parameter of the electrically operated aerosol-generating system;

comparing the second input to the adjusted second range of allowable values for the second parameter;

providing the authorizing signal, further indicating that the second input is within the adjusted second range of allowable values for the second parameter; and adjusting the second parameter, in dependence on the authorizing signal.

3. The method according to claim 1, further comprising:

determining a required adjustment to at least one further parameter, dependent on at least one of the first parameter and the second parameter, and in dependence on at least one of the first input and the second input; and adjusting the at least one further parameter, in dependence on the authorizing signal.

4. The method according to claim 2, wherein the first range of allowable values for the first parameter and the second range of allowable values for the second parameter are respectively adjusted in dependence on a value of the first parameter and a value of the second parameter.

5. The method according to claim 1, wherein the determining the adjustment to the second range of allowable values for the second parameter further comprises using a look-up table correlating a value input from the user for the first parameter to a value of the second parameter.

6. The method according to claim 1, further comprising requesting a confirmation input from the user before the adjusting.

7. The method according to claim 1, wherein at least one of the first parameter and the second parameter relates to an aerosol characteristic.

8. The method according to claim 1, wherein at least one of the first parameter and the second parameter relates to an aerosol-generating device of the system.

9. An electrically operated aerosol-generating device, comprising:

a power supply;

control circuitry;

an input configured to receive at least one user input; and an electrical heater configured to receive power from the power supply via the control circuitry, and to heat an aerosol-forming substrate, wherein the control circuitry is configured to perform the method according to claim 1.

10. The electrically operated aerosol-generating device according to claim 9, wherein the input is further configured to receive the at least one user input from a remote device.

11. An electrically operated aerosol-generating system, comprising:

an electrically operated aerosol-generating device, comprising:

a power supply, control circuitry, an input configured to receive at least one user input, and an electrical heater configured to receive power from the power supply via the control circuitry, and to heat an aerosol-forming substrate;

an electronic display device configured to perform the method of claim 1, the display device being further configured to:

display a plurality of adjustable parameter values, each parameter value of said plurality corresponding to a parameter of the electrically-operated aerosol-generating system, parameters in said plurality being dependent on each other, display a range of allowable values for each of the plurality of adjustable parameter values, and display an adjusted range of allowable values for at least one of the plurality of adjustable parameter values in dependence on the at least one user input being a request to adjust another parameter value of said plurality, the display device comprising a storage medium comprising a set containing the plurality of parameter values, wherein:

a first value of the plurality of parameter values corresponds to a maximum allowable value for the corresponding parameter of the electrically-operated aerosol-generating system, and other values of the plurality of parameter values correspond to required values to enable the first parameter to be the maximum allowable value; and a communications link provided between the electrically operated aerosol-generating device and the electronic display device.

12. The electrically operated aerosol-generating system according to claim 11, the electronic display device being a touchscreen device further configured to receive the user input.

* * * * *